United States Patent [19]

Inglis

[11] Patent Number: 4,775,056

[45] Date of Patent: Oct. 4, 1988

[54] SELF-STORING HORIZONTAL SUPPORT

[76] Inventor: Douglas R. Inglis, 4111 E. Packard Hwy., Charlotte, Mich. 48813

[21] Appl. No.: 128,601

[22] Filed: Dec. 4, 1987

[51] Int. Cl.[4] ..... A47F 5/08

[52] U.S. Cl. ..... 211/105.3; 211/100; 211/123

[58] Field of Search ..... 211/105.1, 105.3, 105.4, 211/123, 100, 101; 248/205.5, 206.3, 206.4, 264

[56] References Cited

U.S. PATENT DOCUMENTS

| | | | |
|---|---|---|---|
| 551,990 | 12/1895 | Murphy . | |
| 829,653 | 8/1906 | Kercher . | |
| 849,035 | 4/1907 | Westenhoff . | |
| 937,376 | 10/1909 | Masden | 211/105.3 |
| 955,135 | 4/1910 | Chlad . | |
| 1,548,175 | 8/1925 | Roseborough . | |
| 1,752,472 | 4/1930 | Whitney | 211/123 |
| 2,951,591 | 9/1960 | LaFurge | 211/105.3 |
| 3,342,484 | 9/1967 | Christensen | 272/85 |
| 3,952,877 | 4/1976 | Kindl | 211/123 X |
| 4,476,606 | 10/1984 | Biorkman et al. | 211/100 X |

FOREIGN PATENT DOCUMENTS

| | | | |
|---|---|---|---|
| 1248597 | 11/1960 | France | 211/105.3 |
| 69380 | 7/1893 | Fed. Rep. of Germany | 211/105.3 |

*Primary Examiner*—Robert W. Gibson, Jr.
*Attorney, Agent, or Firm*—Beaman & Beaman

[57] ABSTRACT

A horizontal support bar for being interposed between spaced vertical surfaces, such as a doorway jamb, bar support members being located at each bar end, and one of the support members being attached to its associated vertical surface and pivotally connected to the bar wherein the bar may swing to a horizontal self-storing position. The bar length is adjustable and cam wedge surfaces are employed to use vertical forces imposed on the bar to increase the frictional engagement between the support members and the associated supporting surfaces.

8 Claims, 1 Drawing Sheet

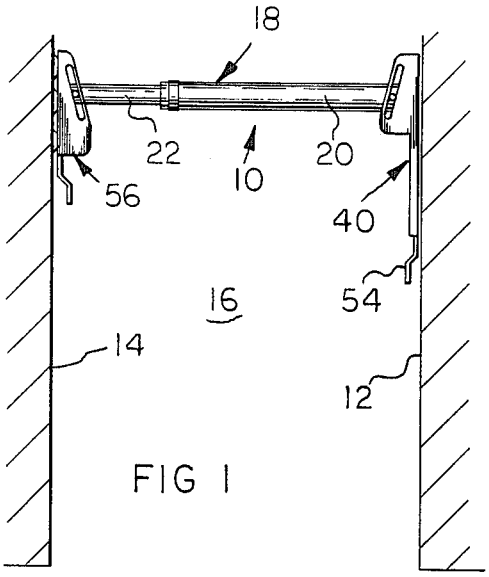
FIG 1
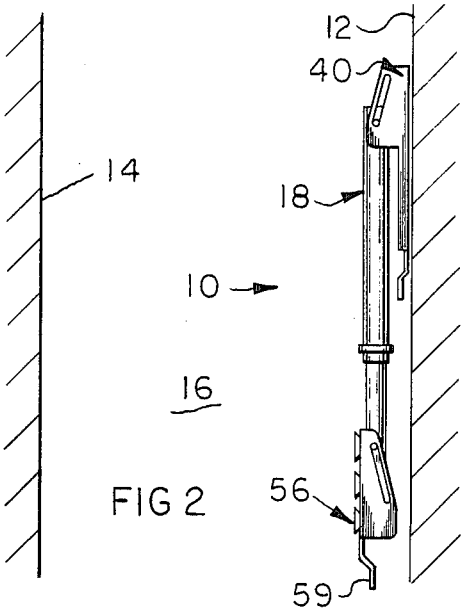
FIG 2
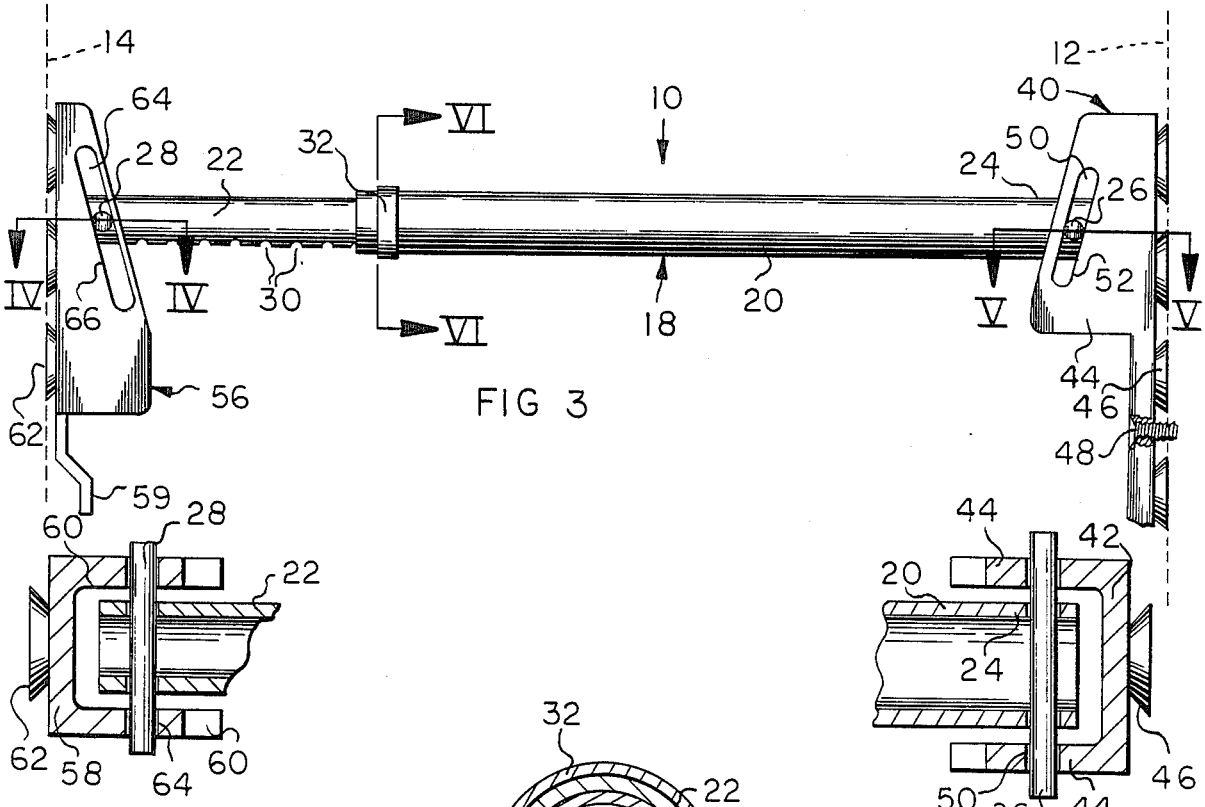
FIG 3
FIG 4
FIG 5
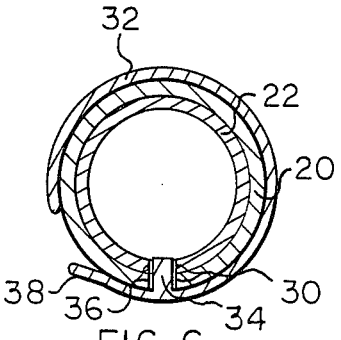
FIG 6

SELF-STORING HORIZONTAL SUPPORT

BACKGROUND OF THE INVENTION

Horizontal bars are used in the home for exercise and gymnastic purposes, and it is known to mount such bars between doorway jambs, examples of such devices being shown in U.S. Pat. Nos. 829,653; 849,035; 1,548,175 and 3,342,484. Such known devices utilize means for supporting the bar between the door jambs, and often such bars use adjustment means, such as threads, to adjust the bar length for accommodating various sizes of doors and to adjust the frictional engagement of the bar ends with the associated door jamb.

Horizontal bars of the above type are usually semi-permanently installed in place, usually at the upper region of the doorway, because of the inconvenience and extensive manipulation required to remove and install the bar. There is a need for a horizontal bar of this type which is self-storing and wherein the bar may be positioned between use and storage positions requiring a minimum of manipulation, and operable with ordinary skills.

It is an object of the invention to provide horizontal support bar apparatus which may be mounted within a doorway between door jambs, is self-storing, and capable of supporting relatively heavy loads.

Another object of the invention is to provide a relatively economical horizontal support bar capable of being installed in a doorway for use with exercise and gymnastic purposes and wherein the bar is readily positionable between a horizontal use position and a substantially vertical storage position which does not interfere with passage through the doorway.

An additional object of the invention is to provide a self-storing horizontal support bar for installation within a doorway wherein the bar is positionable between use and storage positions and frictional engagement between the bar and doorway increases proportional to the vertical load being applied to the bar.

A self-storing horizontal support bar constructed in accord with the invention includes a tubular bar formed of two telescopingly associated portions interconnected by a detent so as to adjustably determine the bar length. Support members are associated with each end of the bar, and the primary support member may be permanently affixed to a vertical door jamb by screws or similar fasteners.

The secondary support member is associated with the other bar end and is not permanently associated with the engaged door jamb but includes means, such as suction cups, to increase the frictional engagement between the support member and the door jamb surface.

The end of the bar associated with the primary support member includes a pivot interposed therebetween wherein the bar may be pivoted between a substantially horizontal use position and a substantially vertical storage position where the bar will be substantially parallel to the door jamb upon which the primary support member is mounted. Additionally, pivot means interconnect the secondary support member and its associated bar end whereby the secondary support member may pivot to a storage position to align the secondary support member with the length of the bar and minimize the space occupied by the apparatus within the door jamb during storage.

The pivot means associated with each end of the bar engage cam or wedge surfaces defined upon the support members whereby vertical weight applied to the bar when in the use position tends to separate the support members and increase the frictional engagement between the support members and their associated door jamb surface. The greater the weight applied to the bar, the greater the frictional engagement between the bar support members and their supporting surfaces.

Positioning of the bar between its use and storage positions is readily accomplished requiring no special skills, and the apparatus is easy to use, may be readily installed, and permits unobstructed use of the doorway when the bar is in the self-storage position.

BRIEF DESCRIPTION OF THE DRAWINGS

The aforementioned objects and advantages of the invention will be appreciated from the following description and accompanying drawings wherein:

FIG. 1 is an elevational view of a support bar in accord with the invention, the doorway being shown schematically, and the bar being illustrated in the use position, FIG. 2 is an elevational view similar to FIG. 1 illustrating the support bar in the self-storage position, FIG. 3 is an elevational view of the support bar of the invention shown in a typical horizontal position, FIG. 4 is a plan sectional view taken along Section IV—IV of FIG. 3 through the secondary support member and associated bar pivot, FIG. 5 is a plan sectional view taken along Section V—V of FIG. 3 through the primary support member and associated bar pivot, and FIG. 6 is an elevational, sectional view taken along Section VI—VI of FIG. 3 through the bar detent.

DESCRIPTION OF THE PREFERRED EMBODIMENT

The support bar apparatus, generally indicated at 10, is adapted to be installed between spaced parallel vertical surfaces 12 and 14, usually comprising the jambs of a doorway, generally represented at 16. Of course, it is to be appreciated that the horizontal bar apparatus of the invention may be installed between any spaced vertical surfaces, and while its use is primarily intended as an exercise bar, it may be used for other purposes, such as supporting garment bags, clothes, children's swings, and the like.

The apparatus utilizes a bar, generally indicated at 18, which consists of a large tube 20 telescopingly receiving the smaller inner tube 22. Tube 20 includes an end 24 receiving the pivot pin 26 fixed therein, FIG. 5, while the outer end of the inner tube 22 includes the pivot pin 28 affixed thereto and diametrically extending therefrom. The inner tube 22 includes a plurality of equally axially spaced holes 30, FIG. 3, and a resilient metal clip 32 circumscribing tube 20 includes a radially extending detent 34 which extends through a radial hole 36 defined in tube 20 and is selectively receivable within a hole 30. The detent clip 32 is resilient wherein grasping the clip end 38, FIG. 6, and deflecting the end away from the tube 20 causes the detent 34 to be radially displaced and withdrawn from the associated tube hole 30. This retraction of the detent permits the tube 22 to be positioned as desired within tube 20 for adjusting the length of the bar 18, and release of the clip end 38 to permit the detent 34 to enter a hole 30 will lock the tubes 20 and 22 together to determine the bar length.

The primary support member 40 is of a generally U-shaped configuration including a base 42 and parallel spaced legs 44. A plurality of suction cups 46 are affixed to the base 42 for engagement with the door jamb surface 12, and a plurality of holes 48 are defined in the base intermediate the suction cups for receiving screws or nails in order to permit the support member 40 to be rigidly affixed to the door jamb 12, if desired.

The support member 40 is of an elongated configuration and its length is vertically oriented with respect to the door jamb 12. At its upper regions, the legs 44 are each provided with a slot 50 whose length is obliquely related to the plane of the base 42, and the slots each include an oblique cam surface 52, FIG. 3, which produce a wedging action as later described. As will be appreciated from FIG. 5, the spacing between the legs 44 is such as to readily receive the outer tube end 24, and the length of the pivot pin 26 is such as to be readily received within the slots 50. An extension tab 54 is defined on base 42 to aid in the release of the suction cups 46.

The secondary support member 56 is of a generally U-shaped configuration including a base 58 having a release tab 59 and spaced parallel legs 60. The outer base surface includes a plurality of spaced suction cups 62, and each of the legs includes an oblique slot 64 defining a cam surface 66. The ends of the pivot pin 28 are received within the slots 64 in a manner appreciated from FIG. 4, and it will be noted that the outer end of the tube 22 is relatively closely received between the legs 60.

In use, the support member 40 will be attached to the door jamb surface 12 by screws, not shown, or the like. If desired, the suction cups 46, alone, may be used to affix the support member to the door jamb, but it is usually desirable that screws be employed if a relatively permanent installation is desired. The length of the support member 40 is vertically oriented wherein the length of the slots 50, and the surfaces 52, will be obliquely related to the vertical, and, preferably, lie in vertical planes.

Due to the pivotal interconnection between the bar 18 and the support member 40 through the pivot pin 26 within slots 50, the apparatus will naturally assume the stored condition of FIG. 2. In this condition the length of the bar 18 will be positioned by gravity extending downwardly substantially parallel to the door jamb 12. Further, due to the pivotal interconnection of the tube 22 with the support member 56 by pin 28, the support member 56 will extend downwardly, and, accordingly, the apparatus 10 will occupy minimal space within the doorway 16.

It will be appreciated that in the stored position of FIG. 2, it is possible to reverse the position of the support member 56 from that shown in FIG. 2 wherein the pin 28 will be associated with the opposite end of the slots 64 which will cause the suction cups 62 to be disposed toward the door jamb 12 and upon the suction cups being pressed against the door jamb 12 the bar 18 will be held in a stable condition when stored.

When it is desired to use the bar 18, the bar is raised to the horizontal position such that the support member 56 will be in horizontally opposed relationship to the upper regions of the support member 40 as shown in FIGS. 1 and 3. If the bar 18 has not previously been adjusted for length, the detent 34 is retracted sufficiently to permit the tube 22 to be telescoped to the position wherein the support member 56 will be engaging, or substantially engaging, the door jamb 14 while the pivot pins 26 and 28 are in the upper regions of their associated slots. The detent 34 is then released to enter a hole 30 to fix the length of the bar 18.

Thereupon the application of weight to the bar 18 will cause the pins 26 and 28 to engage the slots cam surfaces 52 and 66, respectively, biasing the support members 40 and 56 away from each other producing high frictional engagement between the support members and their associated door jambs. In this manner, the bar 18 is capable of supporting the weight of even a heavy individual with utmost safety.

After use, the user merely raises the bar 18 which will retract the support members 56 toward support member 40 and permit the bar 18 to swing to the storage position of FIG. 2. Release tab 59 may have to be lifted to break the vacuum at cups 62.

It will be appreciated that the practice of the invention permits a horizontal support bar usable for exercise and gymnastics to be easily installed in a use position within a doorway, and also permits the support bar to be pivoted to a self-storing position to provide unrestricted use of the doorway. The apparatus of the invention may be manufactured by conventional fabrication techniques at relatively low costs, and the apparatus may be installed and used by a person of ordinary skills.

It is appreciated that modifications to the inventive concepts may be apparent to those skilled in the art without departing from the spirit and scope of the invention.

What is claimed is:

1. A self-storing horizontal support bar adapted to be interposed between spaced vertical opposed support surfaces and characterized by its ability to support heavy weight comprising, in combination, an elongated bar having an axis and first and second ends, a first support member adjacent said first end, first pivot means pivotally mounting said first support member to said bar first end, a second support member mounted upon said bar second end, attachment means defined upon said first support member for attaching said first support member to one of the support surfaces, said pivot means permitting said bar to pivot in a vertical plane between a substantially horizontal use position wherein said second support member engages the other support surface and a substantially vertical storage position adjacent said one support surface, and weight operated bar displacement means interposed between a bar end and the associated support member axially displacing said bar toward the other support member when weight is applied to said bar while in said horizontal use position to frictionally wedge said bar between said support members.

2. In a self-storing horizontal support as in claim 1, said attachment means including a plurality of suction cups.

3. In a self-storing horizontal support as in claim 1, said attachment means including holes defined in said first support member for receiving fasteners for affixing said first support member to said one support surface.

4. In a self-storing horizontal support bar adapted to be interposed between spaced vertical opposed support surfaces and characterized by its ability to support heavy weight comprising, in combination, an elongated bar having an axis and first and second ends, a first support member adjacent said first end, first pivot means pivotally mounting said first support member to said bar first end, a second support member mounted upon said bar second end, attachment means defined upon said first support member for attaching said first support member to one of the support surfaces, said pivot means permitting said bar to pivot in a vertical plane between a substantially horizontal use position wherein said second support member engages the other support surface and a substantially vertical storage position adjacent said one support surface, and bar displacement means interposed between a bar end and the associated support member axially displacing said bar toward the other support member when said bar is in said horizontal use position to frictionally wedge said bar between said support members, said bar displacement means comprising wedge means interposed between said associated support member and the adjacent bar end whereby weight imposed on said bar while in said horizontal use position axially biases said bar toward the other support member to increase the frictional engagement between said support member and their associated surfaces.

5. In a self-storing horizontal support as in claim 4, said first support member being of an elongated configuration having a longitudinal axis and adapted to be vertically oriented on said one support surface, said wedge means comprising wedge surfaces defined on said first support member obliquely oriented to said longitudinal axis and said one support surface, said first pivot means operatively cooperating with said wedge surfaces.

6. In a self-storing horizontal support as in claim 5, said first support member including a pair of substantially parallel spaced plates, a slot defined in each of said plates, the edges of said slots defining said wedge surfaces, said first pivot means comprising a pivot pin mounted in said bar first end having ends extending into said slots.

7. In a self-storing horizontal support as in claim 6, said second support means including a pair of substantially parallel spaced plates, a slot defined in each of said plates, the edges of said slots defined in said second support member defining wedge surfaces obliquely disposed to said other support surface when said bar is in said bar second end having ends extending into said second support member slots.

8. In a self-storing horizontal support bar adapted to be interposed between spaced vertical opposed support surfaces and characterized by its ability to support heavy weight comprising, in combination, an elongated bar having an axis and first and second ends, a first support member adjacent said first end, first pivot means pivotally mounting said first support member to said bar first end, a second support member mounted upon said bar second end, attachment means defined upon said first support member for attaching said first support member to one of the support surfaces, said pivot means permitting said bar to pivot in a vertical plane between a substantially horizontal use position wherein said second support member engages the other support surface and a substantially vertical storage position adjacent said one support surface, and bar displacement means interposed between a bar end and the associated support member axially displacing said bar toward the other support member when said bar is in said horizontal use position to frictionally wedge said bar between said support members, second pivot means pivotally mounting said second support member upon said bar second end about an axis substantially parallel to the axis of said first pivot means whereby said second support means may pivot to a storage position relative to said bar upon said bar pivoting to its storage position.

* * * * *